United States Patent [19]

Rhorer et al.

[11] 4,130,079

[45] Dec. 19, 1978

[54] AUXILIARY STEERING CONTROL FOR ELECTRIC TROLLING MOTOR

[76] Inventors: William F. Rhorer, 5961 Stoneshire, Baton Rouge, La. 70805; Joseph V. Zito, 855 Princewood Ct., Baton Rouge, La. 70806

[21] Appl. No.: 806,173

[22] Filed: Jun. 13, 1977

[51] Int. Cl.[2] ..... B63H 5/12

[52] U.S. Cl. ..... 115/18 E; 114/146; 114/153

[58] Field of Search ..... 115/18 R, 18 E, 17; 114/153, 144 R, 146

[56] References Cited

U.S. PATENT DOCUMENTS

| | | | |
|---|---|---|---|
| 2,545,086 | 3/1951 | Harris | 115/18 E |
| 2,688,299 | 9/1954 | Gload et al. | 115/18 R |
| 2,720,185 | 10/1955 | Sever et al. | 115/18 R |
| 2,804,838 | 9/1957 | Moser | 115/18 E |
| 3,602,181 | 8/1971 | Harris | 115/18 E |

*Primary Examiner*—Trygve M. Blix
*Assistant Examiner*—Sherman D. Basinger
*Attorney, Agent, or Firm*—James M. Pelton

[57] ABSTRACT

An auxiliary steering control for a remote control electric trolling motor in which a coupling is attached to a second pinion of a rack and pinion steering mechanism for an outboard motor, the coupling having a socket for attaching an auxiliary control rod so that upon failure of the foot pedal control cable the control handle is inserted into the socket and the boat can be manually steered until the day's fishing is completed.

2 Claims, 5 Drawing Figures

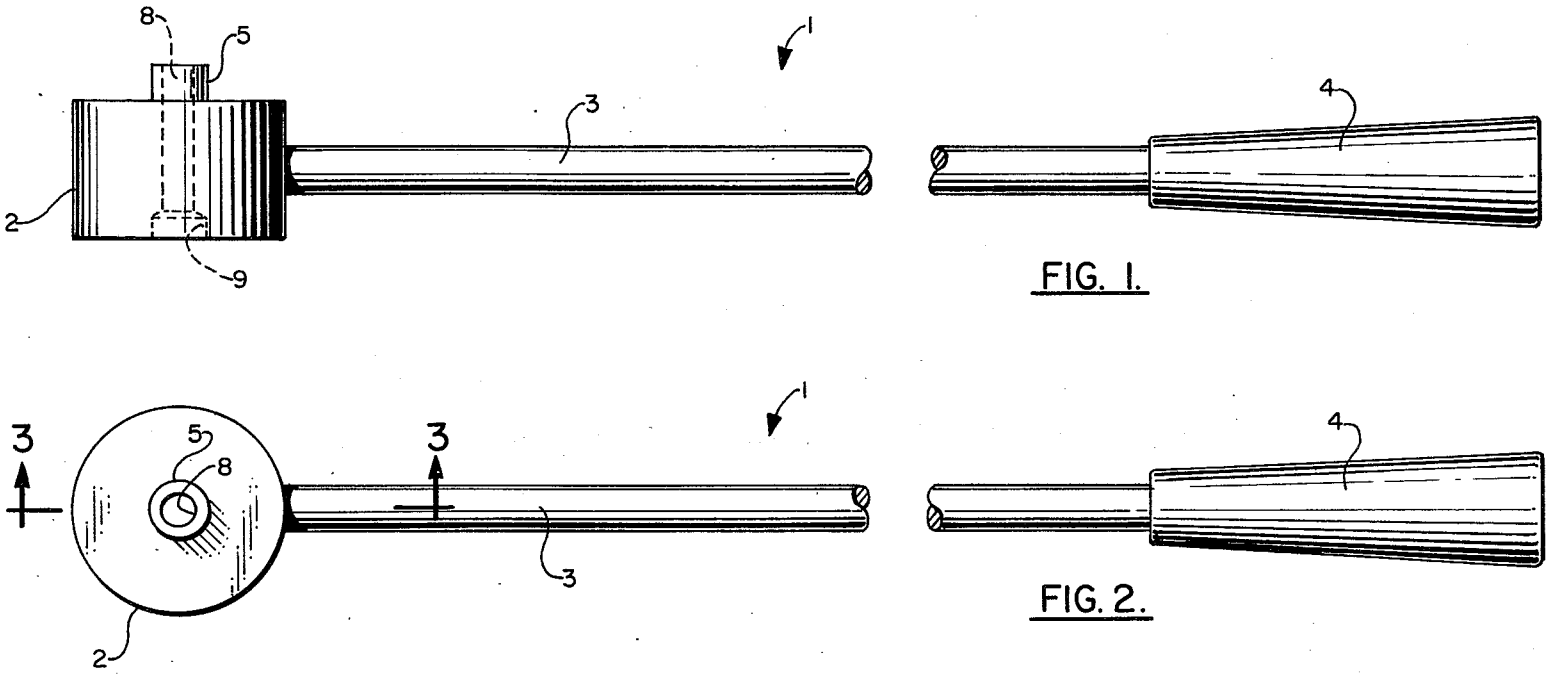
FIG. 1.
FIG. 2.
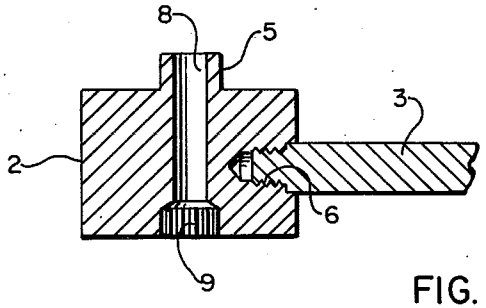
FIG. 3.

AUXILIARY STEERING CONTROL FOR ELECTRIC TROLLING MOTOR

BACKGROUND OF THE INVENTION

This invention relates to means for steering boats using an electric trolling motor of the remote control type. More particularly, the invention relates to a method and apparatus for enabling the operator of the boat and motor to steer the electric trolling motor when the remote control cable is rendered inoperative by breakage or failure.

In recent years, fishermen have come to rely on an electric outboard motor, generally known as a "trolling motor", for boating noiselessly through water without alarming wary fish. Power for such motors is commonly supplied by a direct current voltage source such as a wet cell DC battery carried aboard the boat.

Electric trolling motors of this type characteristically fall into one or two categories, i.e., a hand operated model and a remote control model. The present invention relates to the remote control model. Usually, the remote control model is equipped with a water-tight DC motor equipped with a propeller on the work shaft. Electrical leads from the motor extend up through an elongated shaft fixed to the motor housing and are ultimately connected to the necessary switching mechanism to control on-off operation and/or variable speed control of the motor. In the remote control electric trolling motor a foot operated pedal is employed to free use of the fisherman's hands for fishing while directional control of the motor as well as on-off operation and/or variable speed control is accomplished by the fisherman's foot acting on the pedal lever, which has the necessary switch and any speed control associated therewith.

Directional control for the remote control trolling motor is conventionally accomplished by extending or retracting a drive cable connected at one end to a centrally pivoted pedal lever. Such action is achieved when the operator ultimately depresses the upper portion of the pedal as with the toe or the foot or depresses the lower portion of the pedal as with the heel of the foot. In one type of remote control trolling motor, the elongate tubular shaft is rotatably mounted in a hollow casing assembly and a hollow pinion is mounted on the elongated shaft. A rack meshes with the hollow pinion and the rack is coupled to a steering control pedal by means of a steering control cable and is mounted for movement in the hollow casing assembly transversely of the shaft. The rack is moved transversely of the shaft for turning the elongate shaft and hence the motor and as well the direction of the propeller for steering the boat. A second pinion which meshes with the rack carries a direction indicating pointer atop the hollow casing so that the fisherman can observe the direction in which the motor is pointing prior to actuation of the motor. Such electric trolling motor steering control is more particularly described in U.S. Pat. No. 3,602,181.

In another type of steering control, a connection for securing the control cable to the drive wheel of the remote control unit has a connection post pivotally mounted offset from the pivot axis of the wheel and includes a radial slot and an axial bore for receiving the L-shape end of the control cable with a cotter pin to retain the end of the control cable securely in the slot and bore. Action of the control cable turns the drive wheel which has a cable securely fastened to its circumference and wrapped several times around the elongate tubular shaft so that movement of the control cable turns the drive wheel which movement in turn is transferred to the elongate shaft for directional control of the motor. Such a steering control connection is more particularly described in U.S. Pat. No. 3,889,625. However, both of these units suffer from the disadvantage of weakness at the control cable and its connections both to the elongate shaft and at the foot pedal operation, as well as liability to breakage or failure in the control cable itself. Once failed, it is difficult or impossible to repair in the field. Accordingly there is a need for an auxiliary manual steering control means which is conveniently adaptable and attachable to the electric trolling motor. The present invention provides such an auxiliary steering control device.

SUMMARY OF THE INVENTION

According to the present invention, there is provided an auxiliary steering control apparatus for a rack and pinion steering mechanism of an outboard motor in which a hollow first pinion is attached to an elongate shaft and meshes with a rack transversely operated by foot pedal actuated control cable and a second pinion, engaged with said rack, carries a direction indicating pointer, said apparatus including a coupling means attached to said second pinion and having a tapped socket for attachment of a control rod whereby on loss of control or breakage of said foot pedal operated control cable, said control rod is attached to said socket in said coupling means for temporary manual steering control.

DESCRIPTION OF THE DRAWINGS

FIG. 1 is a side elevation view of the auxiliary steering apparatus of this invention.

FIG. 2 is a top plan view of the auxiliary steering apparatus of this invention.

FIG. 3 is a partial cross-section of the invention showing the internal bore and the socket connected for the control rod.

Referring to the drawings in greater detail, FIG. 1 shows an auxiliary steering control apparatus 1, which includes a coupling means 2 being attached to control rod 3 at one end and having knob 4 attached to the other end of control rod 3. The coupling means 2 is generally cylindrical in shape but this is not necessary, as it can be any other shape so long as it can accommodate or adapt to the attachment of the direction indicating pointer, such as by seating flange 5 on its upper surface, and bore 8 for receiving attaching screw (not shown). Bore 8 goes through direction indicating pointer seating flange 5 and terminates at the lower end of coupling means 2 in a socket 9 by which coupling means 2 is seated on the second pinion of a rack and pinion steering control system as described in U.S. Pat. No. 3,602,181, which is hereby incorporated by reference as if fully set forth. Coupling means 2 also has tapped socket 6 for receiving the threaded end of control rod 3 and attachment of control rod 3 and knob 4 to the coupling means 2.

In FIG. 3, the apparatus is shown in cross-sectional view and illustrates in more detail the relationship of bore 8 and pinion socket 9. Tapped socket 6 for receiving control rod 3 is also shown in more detail. Further, the threaded end of control rod 3 has a short section in which no threads are present to give added strength and the diameter of control rod 3 is also somewhat larger than tapped socket 6.

Figure 4:
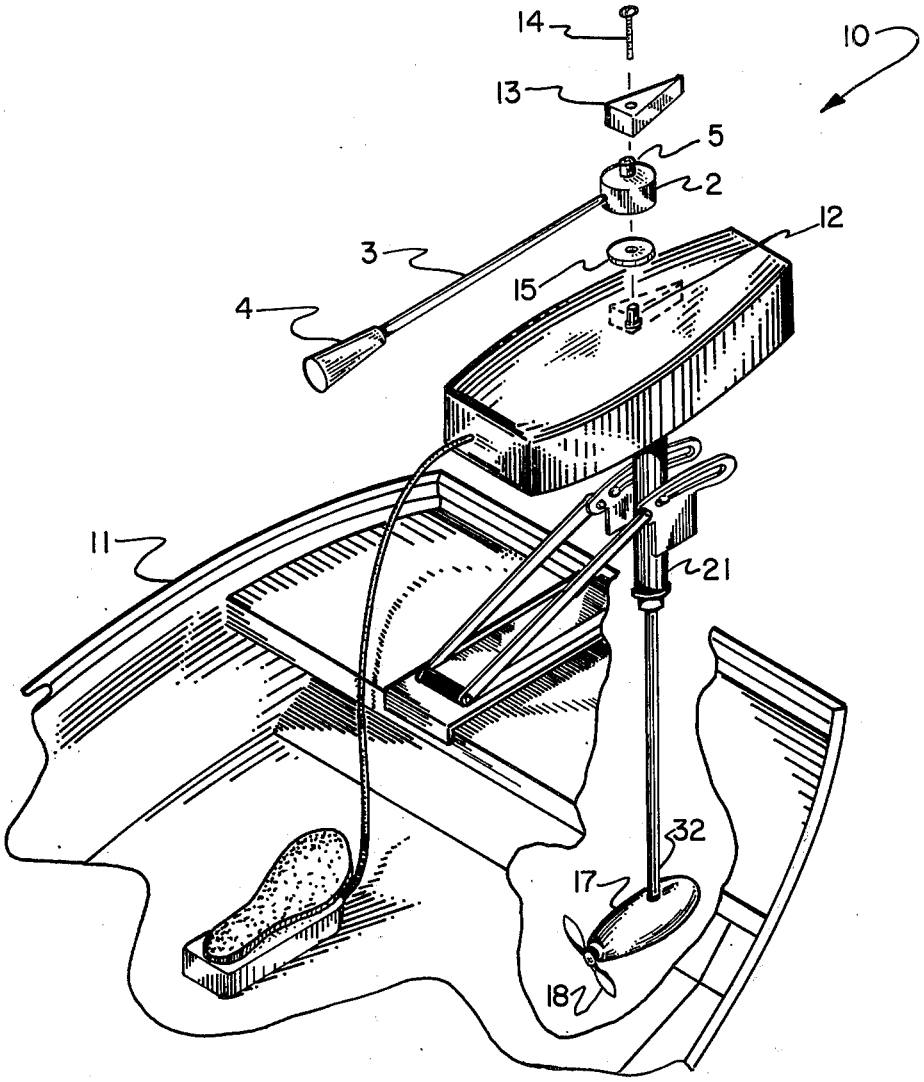
FIG. 4 is a schematic representation of the trolling motor in use and the attachment of the auxiliary control means to an electric remote control motor.

In operation, electric trolling motors of the type in which this invention is most useful have a rack and pinion steering mechanism controlled by foot pedal operated control cable. On failure of the control cable for whatever reason, fishing would be ended because there is no other convenient means for steering the trolling motor. However, with the present auxiliary steering control apparatus at hand, it is only necessary, as shown in FIG. 4, to first remove the direction indicating pointer 13 from the top of the electric trolling motor by removing the attaching screw, placing a washer 15 over the second pinion shaft 12, seating the coupling means 2 over the second pinion shaft 12 in socket 9, replacing the direction indicating pointer 13 on seating flange 5 and inserting a long attaching screw 14 to compensate for the height of the coupling means 2. In this manner, boat 11 can be steered by manually using the auxiliary steering control apparatus 1 attached to the electric trolling motor 10 through elongate tubular shaft 32 to motor housing 17 containing a conventional electric motor (not shown) which turns propeller 18, and the remainder of the time for fishing is not completely lost because of lack of steering of the electric trolling motor.

Figure 5:
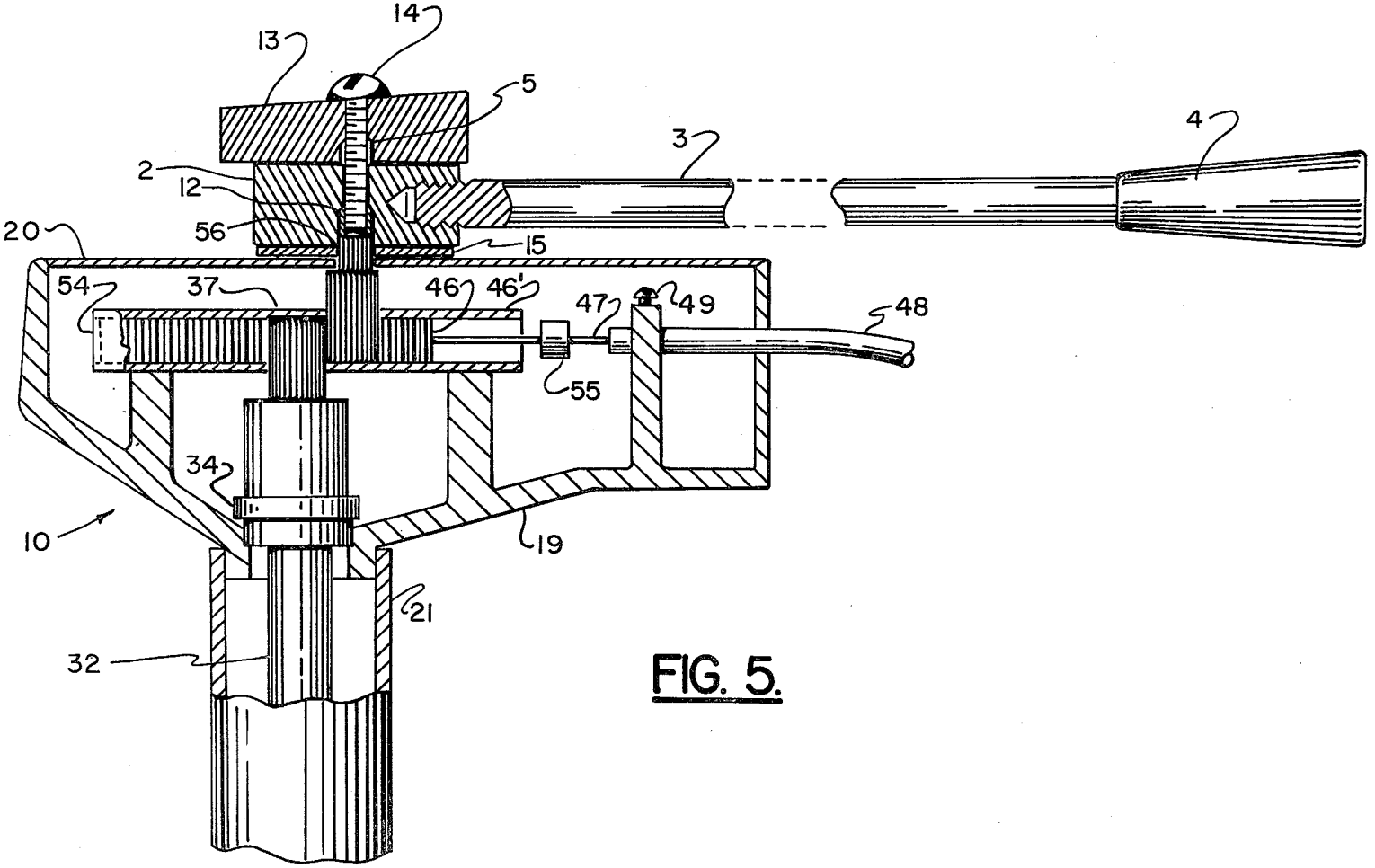
FIG. 5 is a partial cutaway drawing of the steering control of the trolling motor of FIG. 4 in which the auxiliary control apparatus is in place and which shows the operation of the auxiliary control apparatus.

As shown in FIG. 5, a hollow head casing 19 is mounted at an upper end of the body sleeve 21 to form a hollow casing assembly. A tubular shaft 32 is rotatably mounted in bearings 34, mounted in the head casing 19, and at the lower end of body sleeve 21. A pinion 37 is fixedly mounted on an upper end of the shaft 32 for rotation in unison therewith. As shown in FIG. 4, a motor housing 17 is mounted on the lower end of the tubular shaft 32. An appropriate electric motor (not shown in detail) inside the motor housing 17 drives a propeller 18 which is directed transversely of the shaft 32.

The pinion 37 meshes with a sliding rack 46. The rack 46 is mounted for sliding lengthwise of a rack guide 46'. The rack is attached to an actuator bowden wire 47 which runs in a flexible sleeve 48, one end of which is attached to the head casing 19 by a clamp screw 49. Movement of the actuator wire 47 accompanies sliding movement of the rack 46 to the left or right as shown in FIG. 5 to turn the pinion 37, the tubular shaft 32, and the motor housing 17 for steering the boat. A second pinion 51, of the same size as the first pinion, rotatably mounted in the head casing 19 meshes with the rack 46 and is turned thereby. Attachment of pointer 13 to coupling means 2 mounted on the upwardly extending shaft 12 carried by the pinion 51 has been described hereinabove. Thus, pointer 13 swings in synchronism with motor 17 and gives an indication of the direction in which the motor is disposed when properly reattached. The coupling means 2 is carried above a top cover 20 of the head casing 19, the shaft 12 extending through an opening 56 to the top cover. A stop member 54 mounted on the rack guide limits leftward movement of the rack as shown in FIG. 5. A stop member 55 may be mounted on the actuator wire 47 to limit rack movement in the opposite direction.

Although this invention has been described with respect to a rack and pinion steering mechanism, it is only necessary for one skilled in the art to consider mechanical connection to the elongate shaft of any trolling motor in order for use on various types of trolling motors. Therefore, having described the invention, one with particularity in one embodiment, those skilled in the art would be able to adapt it to other styles and types of electric trolling motors for use as an auxiliary steering control apparatus. Accordingly, it is desired that the present invention be limited only by the legal scope of the attached claims.

We claim:

1. In a steering control apparatus for a rack and pinion steering mechanism of an outboard motor in which an elongate shaft is rotatably attached at its upper end to a hollow casing, which is fixedly attached to a boat, and at its lower end is fixedly attached to a motor housing containing an electric motor which drives a propeller transversely of said shaft, said shaft having a hollow first pinion mounted thereon which is continuously in mesh with a sliding rack operatively connected by a control cable to a foot pedal actuator so that operation of the foot pedal causes the elongate shaft to turn, thereby steering the boat, and a second pinion also continuously engaged with the sliding rack and carrying a direction-indicating pointer, the improvement comprising an auxiliary steering apparatus including a coupling means attached to said second pinion in the shape of a cylindrical collar having a flange for attachment of said direction-indicating pointer at its upper end, an axial bore through said flange and said collar ending at its lower end in a socket, opposite said flange, and having a larger diameter than said bore for receiving the shaft of said second pinion and said coupling means having a tapped socket axially transverse of said bore for receiving one end of an auxiliary control rod whereby upon loss of control or failure of said foot pedal actuator or said control cable, said control rod is attached to said tapped socket for receiving one end of said control rod in said coupling means for temporary manual steering control.

2. The apparatus of claim 1 in which said coupling means and said direction indicating pointer are fixed in position by attaching means to said second pinion.

* * * * *